US011608943B1

(12) United States Patent
Liang et al.

(10) Patent No.: US 11,608,943 B1
(45) Date of Patent: Mar. 21, 2023

(54) DIRECTION ADJUSTABLE LED LAMP USED IN A SIGN

(71) Applicant: RISHANG OPTOELECTRONICS CO., LTD., Shenzhen (CN)

(72) Inventors: Jun Liang, Shenzhen (CN); Dulin Tao, Shenzhen (CN); Xiaomin Yan, Shenzhen (CN)

(73) Assignee: RISHANG OPTOELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 17/509,086

(22) Filed: Oct. 25, 2021

(51) Int. Cl.

| | |
|---|---|
| ***F21K 9/278*** | (2016.01) |
| ***F21V 19/00*** | (2006.01) |
| ***F21V 17/10*** | (2006.01) |
| ***F21V 21/005*** | (2006.01) |
| ***F21K 9/275*** | (2016.01) |
| ***F21K 9/272*** | (2016.01) |
| ***F21V 29/83*** | (2015.01) |
| ***F21V 23/00*** | (2015.01) |
| ***F21Y 115/10*** | (2016.01) |
| ***F21V 21/35*** | (2006.01) |

(52) U.S. Cl.
CPC ..... *F21K 9/278* (2016.08); *F21K 9/272* (2016.08); *F21K 9/275* (2016.08); *F21V 17/10* (2013.01); *F21V 21/005* (2013.01); *F21V 23/009* (2013.01); *F21V 29/83* (2015.01); *F21V 19/002* (2013.01); *F21V 19/005* (2013.01); *F21V 21/35* (2013.01); *F21Y 2115/10* (2016.08)

(58) Field of Classification Search
CPC ..... F21V 17/10; F21V 29/83
See application file for complete search history.

(56) References Cited

U.S. PATENT DOCUMENTS

| | | | | |
|---|---|---|---|---|
| 10,222,052 | B1 * | 3/2019 | Ter-Hovhannisyan | F21S 8/043 |
| 10,883,669 | B2 * | 1/2021 | Brown | F21V 23/002 |
| 2013/0094238 | A1 * | 4/2013 | Huang | F21V 29/89 362/555 |
| 2019/0346091 | A1 * | 11/2019 | Zhang | F21S 2/005 |

FOREIGN PATENT DOCUMENTS

| | | | | |
|---|---|---|---|---|
| WO | WO-2013167419 | A1 * | 11/2013 | F21K 9/27 |
| WO | WO-2021122844 | A1 * | 6/2021 | F21V 17/164 |

* cited by examiner

*Primary Examiner* — Alan B Cariaso

(57) ABSTRACT

The present disclosure provides a direction adjustable LED lamp used in a sign, which includes a lamp body, two lamp holders arranged on an upper end and a lower end of the lamp body respectively, a plurality of LED modules installed on a surface of the lamp body, an outer casing installed in the lamp body, a buffer column installed on a surface of the outer casing, an isolated constant current driver installed in the outer casing, the lamp body defines a limit groove closing to the LED modules, and a horizontal plate is installed in the limit groove.

7 Claims, 6 Drawing Sheets

DIRECTION ADJUSTABLE LED LAMP USED IN A SIGN

FIELD

The present disclosure relates to the technical field of LED lamp, in particular to a direction adjustable LED lamp used in a sign.

BACKGROUND

An LED lamp commonly includes a supporter, an electroluminescent semiconductor chip fixed to the supporter through a silver glue or a white glue, and a circuit board connected to the electroluminescent semiconductor chip through a silver wire or a gold wire, and a housing configured for receiving the electroluminescent semiconductor chip, the supporter, and the circuit board. A periphery of the electroluminescent semiconductor chip is sealed through an epoxy resin to protect the core wire in the electroluminescent semiconductor chip.

The LED lamp further includes a lamp body, two lamp heads arranged on two ends of the lamp body respectively, a plurality of LED modules fixed to the lamp body, a driver installed in the lamp body, and a lamp holder. An output end of the driver is connected to the LED modules through an electric wire, and an input end of the driver is connected to the lamp heads. The driver is electrically connected to the lamp holder through the lamp heads.

However, it is complicated to assemble the existing LED lamp that is used in a sign. And the existing LED lamp has disadvantages of high power consumption, poor heat dissipation, short service life, and so on.

Therefore, it is necessary to provide a direction adjustable LED lamp used in a sign to solve the above technical problems.

SUMMARY

The objection of the present disclosure is to provide a direction adjustable LED lamp used in a sign, so as to solve the above-mentioned problems in the background.

In order to achieve the above objection, the present disclosure provides the following technical solutions:

A direction adjustable LED lamp used in a sign includes a lamp body, two lamp holders arranged on an upper end and a lower end of the lamp body respectively, a plurality of LED modules installed on a surface of the lamp body, an outer casing installed in the lamp body, a buffer column installed on a surface of the outer casing, an isolated constant current driver installed in the outer casing, the lamp body defines a limit groove closing to the LED modules, and a horizontal plate is installed in the limit groove.

As a further technical solution of the present disclosure, a junction of the lamp body and each of the LED modules is provided with an installing buckle, and two connecting claws are installed on two ends of each of the installing buckles respectively.

In this way, the connecting claws can be inserted in the surface of the lamp body.

As a further technical solution of the present disclosure, a plurality of LED chips are installed in each of the LED modules, and the LED modules are electrically connected through a connecting wire.

As a further technical solution of the present disclosure, the lamp holder includes a lamp head body, a copper needle, a first connecting hole, a second connecting hole, and a lamp holder body, the lamp head body is connected to the lamp holder body through the copper needle, the first connecting hole is defined at a side of the lamp holder body, and the second connecting hole is defined in the lamp holder body and perpendicular to the first connecting hole.

As a further technical solution of the present disclosure, the lamp holder body includes an electronic wire, a copper sheet, and a copper tube, the copper tube is installed above the copper sheet, and the electronic wire is installed at a center of a side of the copper sheet away from the copper tube.

As a further technical solution of the present disclosure, a number of the first connecting hole is two, and a number of the second connecting hole is two, and the first connecting holes are perpendicular to the second connecting holes.

In this way, a relative position between the lamp head body and the lamp holder body can be changed to adjust the light emitting direction of the LED lamp.

As a further technical solution of the present disclosure, the copper tube has a hollow cylindrical structure, and the copper tube is embedded in the first connecting hole and the second connecting hole.

As a further technical solution of the present disclosure, the horizontal plate is installed in the limit groove, and two sides of a junction of the horizontal plate and an inner side of the limit groove defines heat dissipation holes.

Compared with the existing art, the present disclosure has the following beneficial effects:

In the present disclosure, the lamp head body can be separated from the lamp holder body, the lamp holder body has two first connecting holes and two second connecting holes, and the first connecting holes are perpendicular to the second connecting holes. So that the relative position between the lamp head body and the lamp holder body can be adjusted to obtain different light emitting directions.

The lamp body defines the limit groove for installing the LED module. The length and width of the limit groove are the same as the length and width of the LED module. So that the horizontal plate installed in the limit groove can support the LED module when the LED module is installed in the limit groove. And, the junction of the horizontal plate and the inner side of the limit groove defines heat dissipation holes for quickly discharging the heat generated by the LED module, so as to prevent the LED module from being damaged due to the poor heat discharge.

The junction of the lamp body and the LED module is provided with the installing buckle, and the installing buckle is configured to connect the LED module with the lamp body tightly.

The surface of the outer casing is arranged with the buffer column. The lamp body squeezes the buffer column when the outer casing is installed in lamp body. In this way, the outer casing can be tightly received in the lamp body.

BRIEF DESCRIPTION OF THE DRAWINGS

The present disclosure will be further described with reference to the accompanying drawings and the exemplary embodiments.

In the figures: 1, lamp holder; 11, lamp head body; 12, copper needle; 13, first connecting hole; 14, second connecting hole; 15, lamp holder body; 16, electronic wire; 17, copper sheet; 18, copper tube; 2, installing buckle; 3, connecting wire; 4, LED module; 5, lamp body; 51, limit groove; 52, horizontal plate; 6, outer casing; 7, isolated constant current driver; 8, buffer column.

DETAILED DESCRIPTION OF THE EMBODIMENTS

The technical solutions in the embodiments of the present disclosure are clearly and completely described in the following with reference to the drawings in the embodiments of the present disclosure. It is obvious that the described embodiments are only a part of the embodiments of the present disclosure, and not all of the embodiments. Based on the embodiments in this application, all other embodiments obtained by a person having ordinary skill in the art without making any creative work fall within the scope of this application. In addition, for the sake of description hereinafter, the directional indications of up, down, left, right in the present disclosure, are the same as the up, down, left, and right directions of the drawings themselves. The descriptions of "first", "second", etc., in the present disclosure are used for descriptive purposes only, and are not to be construed as indicating or implying their relative importance.

Embodiment One

Figure 1:
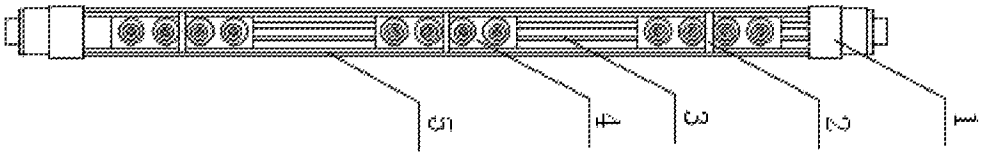
FIG. 1 is a top view of a direction adjustable LED lamp used in a sign of the present disclosure.
Figure 2:
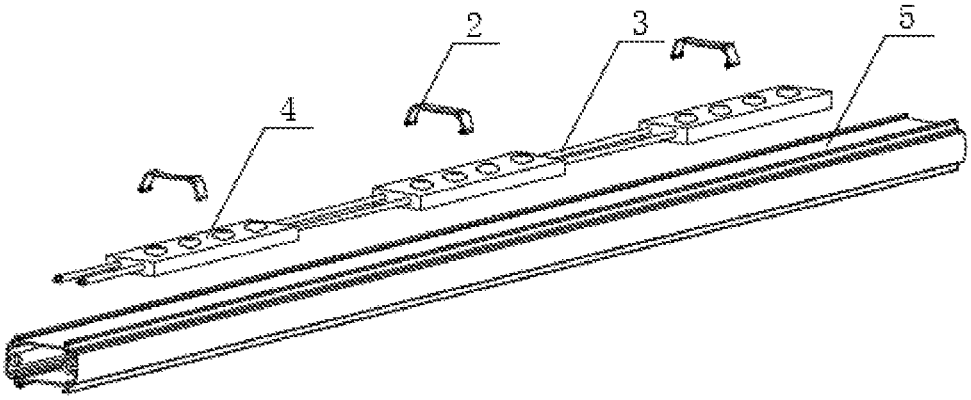
FIG. 2 is an exploded view of the direction adjustable LED lamp used in the sign of the present disclosure.
Figure 3:
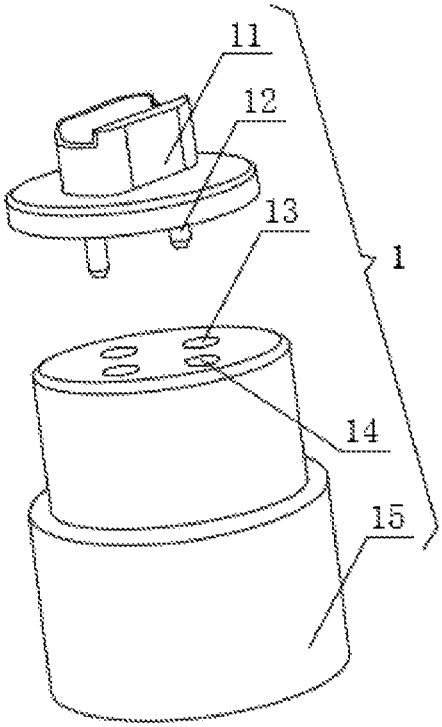
FIG. 3 is an exploded view of a lamp holder of the direction adjustable LED lamp used in the sign of the present disclosure.
Figure 4:
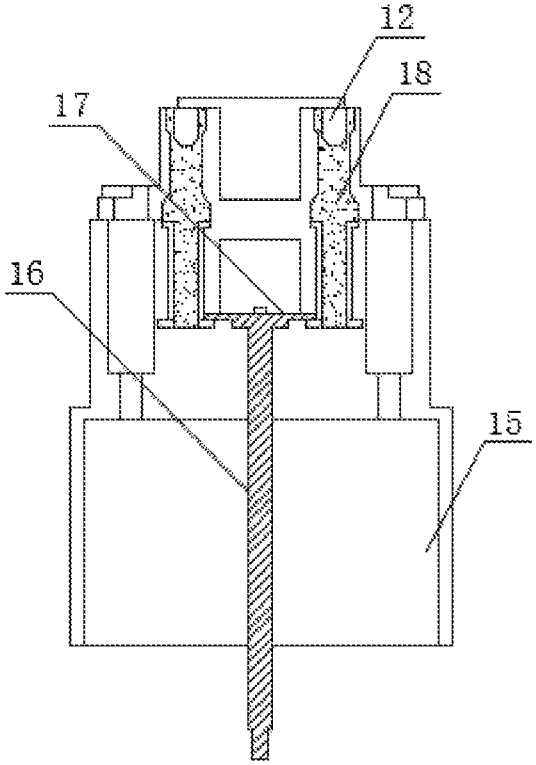
FIG. 4 is a cross section view of a lamp holder body of the lamp holder of the present disclosure.
Figure 5:
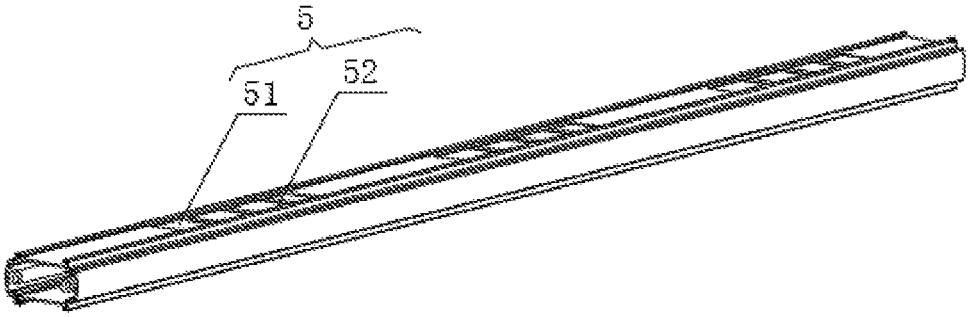
FIG. 5 is a schematic structural view of a lamp body of the direction adjustable LED lamp used in the sign of the present disclosure.
Figure 6:
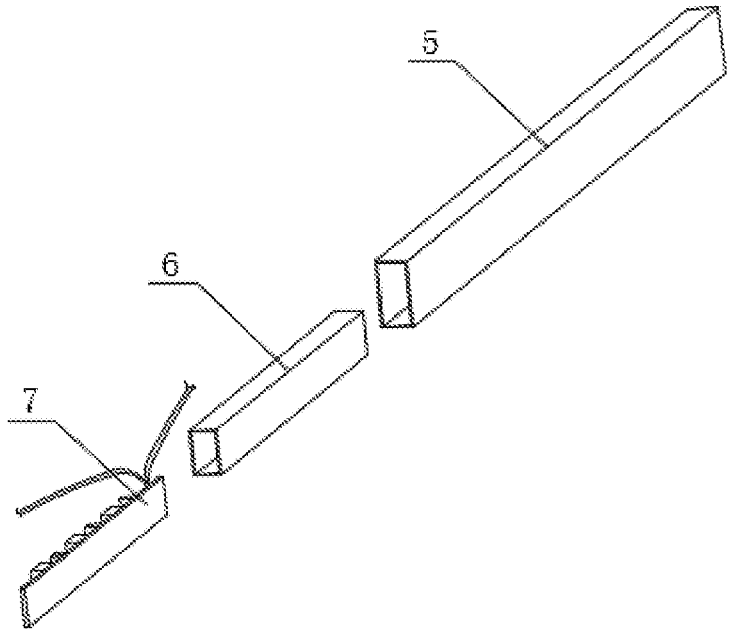
FIG. 6 is a schematic structural view of an isolated constant current driver, an outer casing, and the lamp body of the direction adjustable LED lamp used in the sign of the present disclosure.
Figure 7:
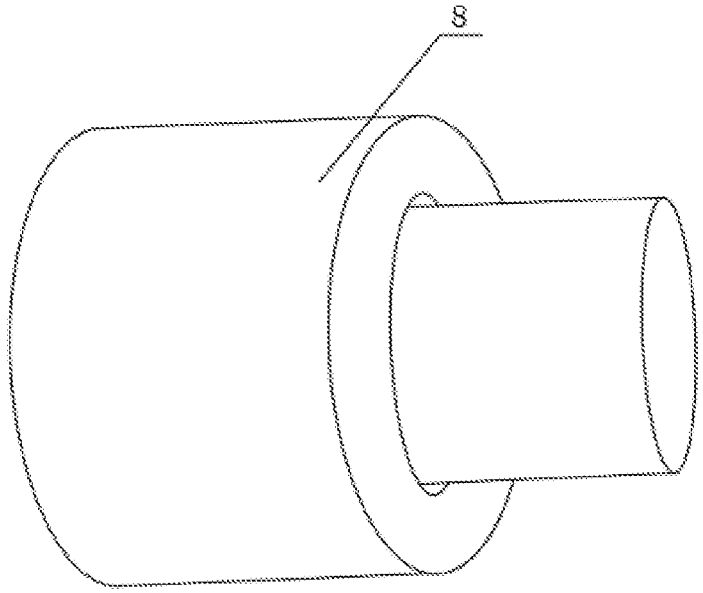
FIG. 7 is a schematic structural view of a buffer column of the direction adjustable LED lamp used in the sign of the present disclosure.
Figure 8:
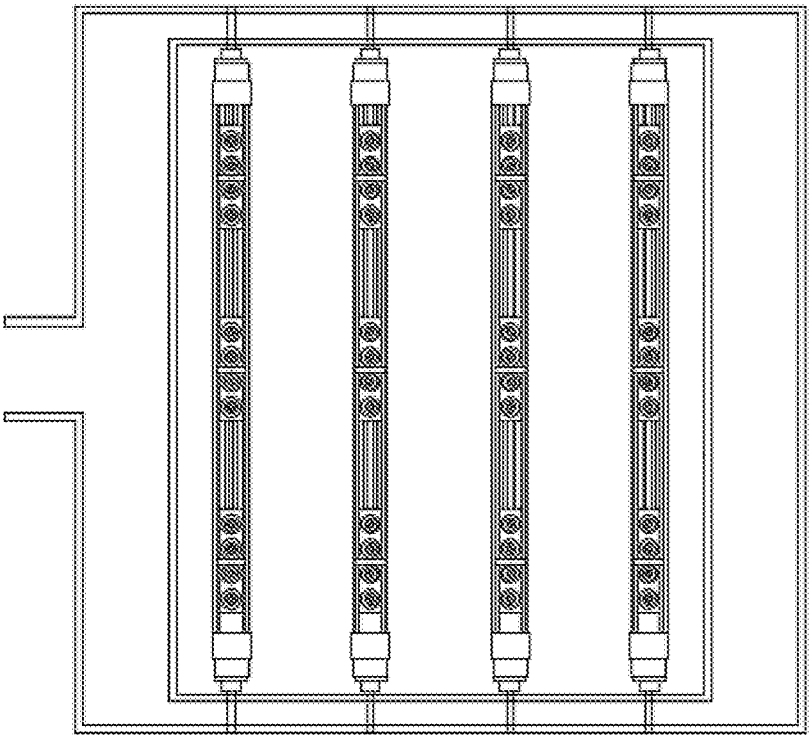
FIG. 8 is a schematic structural view of the direction adjustable LED lamp used in the sign of the present disclosure.
Figure 9:
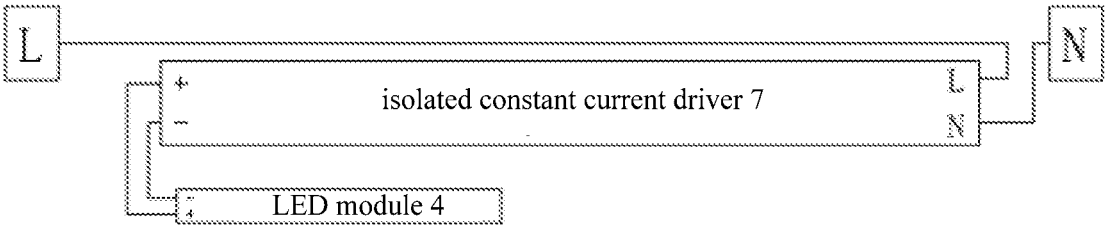
FIG. 9 is a circuit connection view of the direction adjustable LED lamp used in the sign of the present disclosure.
Figure 10:
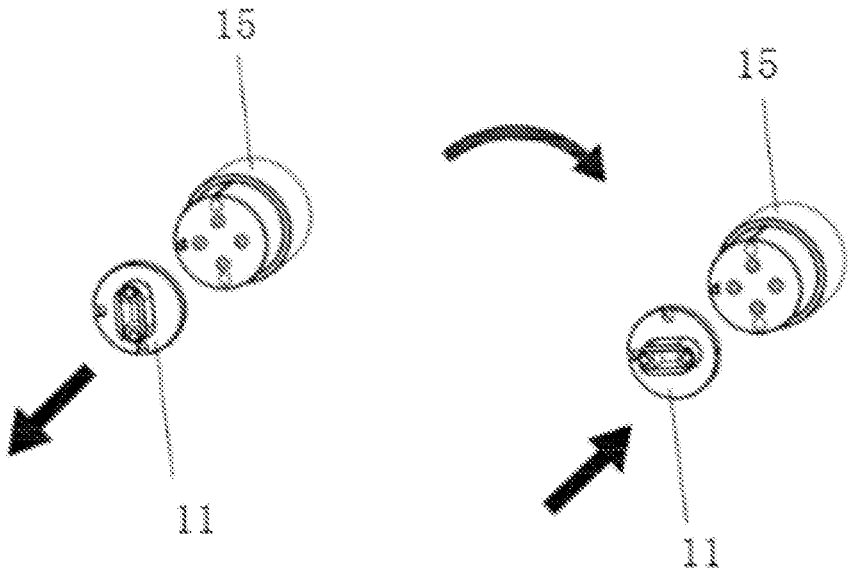
FIG. 10 is a schematic view of rotating the lamp head body of the direction adjustable LED lamp used in the sign of the present disclosure.

The exemplary embodiment of the present disclosure provides detail structures of a direction adjustable LED lamp used in a sign. Referring to FIGS. 1-10, the direction adjustable LED lamp includes a lamp body 5 which is an extrudate, two lamp holders 1 are arranged on an upper end and a lower end of the lamp body 5 respectively, a plurality of LED modules 4 are installed on a surface of the lamp body 5, an outer casing 6 is installed in the lamp body 5, a buffer column 8 is installed on a surface of the outer casing 6, an isolated constant current driver 7 is installed in the outer casing 6, the lamp body 5 defines at least one limit groove 51 closing to the LED modules 4, and a horizontal plate 52 is installed in the limit groove 51.

A junction of the lamp body 5 and each of the LED modules 4 is provided with an installing buckle 2, and two connecting claws are installed on two ends of each of the installing buckles 2 respectively.

The horizontal plate 52 is installed in the limit groove 51 and near a bottom of the limit groove 51, and two sides of a junction of the horizontal plate 52 and an inner side of the limit groove 51 defines heat dissipation holes.

Through the above technical solutions:

The lamp body 5 defines the limit groove 51 configured for installing the LED module 4. A length and a width of the limit groove 51 are the same as a length and a width of the LED module 4. The horizontal plate 52 in the limit groove 51 is configured to support the LED module 4. The heat dissipation holes defined on the junction of the horizontal plate 52 and the inner side of the limit groove 51 can be configured to quickly discharge the heat generated by the LED modules 4, so as to prevent the LED module 4 from being damaged due to the poor heat discharge.

Embodiment Two

The exemplary embodiment of the present disclosure provides detail structures of another direction adjustable LED lamp used in a sign. Referring to FIGS. 1 to 10, a plurality of LED chips are installed in each of the LED modules 4, two ends of each of the LED modules 4 are arranged with connecting wire 3, and the LED modules 4 are electrically connected through the connecting wire 3.

The lamp holder 1 includes a lamp head body 11, a copper needle 12, a first connecting hole 13, a second connecting hole 14, and a lamp holder body 15, the lamp head body 11 is connected to the lamp holder body 15 through the copper needle 12, the first connecting hole 13 is defined at a side of the lamp holder body 15, and the second connecting hole 14 is defined in the lamp holder body 15 and perpendicular to the first connecting hole 13.

The lamp holder body 15 includes an electronic wire 16, a copper sheet 17, and a copper tube 18, the copper tube 18 is installed above the copper sheet 17, and the electronic wire 16 is installed at a center of a side of the copper sheet 17 away from the copper tube 18.

A number of the first connecting hole 13 is two, and a number of the second connecting hole 14 is two, and the first connecting holes 13 are perpendicular to the second connecting holes 14. The copper needle 12 can be inserted in the first connecting hole 13 or the second connecting hole 14, for adjusting the light emitting direction.

The copper tube 18 has a hollow cylindrical structure, and the copper tube 18 is embedded in the first connecting hole 13 and the second connecting hole 14.

Through the above technical solutions:

The copper needle 12 is connected to the copper tube 18, the copper tube 18 is riveted to the copper sheet 17, the copper sheet 17 is riveted to the electronic wire 16, and the electronic wire 16 is electrically connected to a power line. So that the LED modules 4 can be electrically connected to a power supply.

The process of installing the LED lamp includes: installing the outer casing 6 in the lamp body 5, installing the isolated constant current driver 7 in the outer casing 6, electrically connecting the isolated constant current driver 7 with the LED modules 4, tightly installing the LED modules 4 in the limit groove 51 of the lamp body 5 through the installing buckle 2, and fixing the lamp holders 1 at two ends of the lamp body 5 respectively.

When in use, the two lamp holders 1 respectively arranged at two ends of the lamp body are electrically connected to the power supply, the copper needle 12 in each of the lamp holders 1 is connected to the copper tube 18, the copper tube 18 is riveted to the copper sheet 17, and the copper sheet 17 is riveted to the electronic wire 16. So that, the electronic wire 16 is electrically connected to the power source, and the LED modules 4 can be energized to emit light.

As the lamp head body 11 can be separated from the lamp holder body 15, and the relative position between the lamp head body 11 and the lamp holder body 15 can be changed. So that the light emitting direction of the LED lamp can be adjusted by changing the relative position between the lamp head body 11 and the lamp holder body 15. In detail, the lamp head body 11 can be separated from the lamp holder body 15, and the lamp body 5 can be rotated, so that the copper needle 13 can be separated from the first connecting hole 13 and inserted into the second connecting hole 14, or separated from the second connecting hole 14 and inserted into the first connecting hole 13.

Further, the lamp head body 11 can be separated from the lamp holder body 15, so that the lamp head body 11 can be connected to lamp head mounting seats arranged in different directions. The lamp head mounting seats in the sign may be horizontally arranged, or vertically arranged. The lamp head body 11 can be pulled from the lamp holder body 15, and the lamp head body 11 can be rotated, so that the copper needle 13 on the lamp head body 11 can be inserted into the first connecting hole 13 or the second connecting hole 14. In this way, the lamp head body 11 can be adapted to lamp head mounting seats arranged in different directions.

The above are only optional embodiments of the present disclosure, and thus do not limit the scope of the present disclosure. Any equivalent structure or equivalent process transformation made by using the description and drawings of the present disclosure is included in the scope of the present disclosure.

What is claimed is:

1. A direction adjustable LED lamp used in a sign, comprising:

a lamp body (5);

two lamp holders (1), arranged on an upper end and a lower end of the lamp body (5) respectively;

a plurality of LED modules (4), installed on a surface of the lamp body (5);

an outer casing (6), installed in the lamp body (5);

a buffer column (8), installed on a surface of the outer casing (6);

an isolated constant current driver (7), installed in the outer casing (6), wherein, the lamp body (5) defines a limit groove (51) closing to the LED modules (4), and a horizontal plate (52) is installed in the limit groove (51);

wherein, the lamp holder (1) comprises a lamp head body (11), a copper needle (12), a first connecting hole (13), a second connecting hole (14), and a lamp holder body (15), the lamp head body (11) is connected to the lamp holder body (15) through the copper needle (12), the first connecting hole (13) is defined at a side of the lamp holder body (15), and the second connecting hole (14) is defined in the lamp holder body (15) and perpendicular to the first connecting hole (13).

2. The direction adjustable LED lamp used in a sign of claim 1, wherein, a junction of the lamp body (5) and each of the LED modules (4) is provided with an installing buckle (2), and two connecting claws are installed on two ends of each of the installing buckles (2) respectively.

3. The direction adjustable LED lamp used in a sign of claim 1, wherein, a plurality of LED chips are installed in each of the LED modules (4), and the LED modules (4) are electrically connected through a connecting wire (3).

4. The direction adjustable LED lamp used in a sign of claim 1, wherein, the lamp holder body (15) comprises an electronic wire (16), a copper sheet (17), and a copper tube (18), the copper tube (18) is installed above the copper sheet (17), and the electronic wire (16) is installed at a center of a side of the copper sheet (17) away from the copper tube (18).

5. The direction adjustable LED lamp used in a sign of claim 1, wherein, a number of the first connecting hole (13) is two, and a number of the second connecting hole (14) is two, and the first connecting holes (13) are perpendicular to the second connecting holes (14).

6. The direction adjustable LED lamp used in a sign of claim 4, wherein, the copper tube (18) comprises a hollow cylindrical structure, and the copper tube (18) is embedded in the first connecting hole (13) and the second connecting hole (14).

7. The direction adjustable LED lamp used in a sign of claim 1, wherein, the horizontal plate (52) is installed in the limit groove (51), and two sides of a junction of the horizontal plate (52) and an inner side of the limit groove (51) defines heat dissipation holes.

* * * * *